US009706847B2

(12) United States Patent
Piretti

(10) Patent No.: US 9,706,847 B2
(45) Date of Patent: Jul. 18, 2017

(54) CHAIR WITH A TILTING BACKREST

(71) Applicant: Pro-Cord S.p.A., Bologna (IT)

(72) Inventor: Alessandro Piretti, Bologna (IT)

(73) Assignee: PRO-CORD S.p.A., Bologna (IT)

( * ) Notice: Subject to any disclaimer, the term of this patent is extended or adjusted under 35 U.S.C. 154(b) by 0 days.

(21) Appl. No.: 15/280,164

(22) Filed: Sep. 29, 2016

(65) Prior Publication Data

US 2017/0095087 A1 Apr. 6, 2017

(30) Foreign Application Priority Data

Oct. 2, 2015 (IT) ..... 102015000057736

(51) Int. Cl.
*A47C 7/44* (2006.01)
*A47C 5/04* (2006.01)
*A47C 5/12* (2006.01)

(52) U.S. Cl.
CPC ..... *A47C 7/44* (2013.01); *A47C 5/04* (2013.01); *A47C 5/12* (2013.01)

(58) Field of Classification Search
CPC ..... A47C 7/44; A47C 5/04; A47C 5/12
USPC ..... 297/285, 354.11
See application file for complete search history.

(56) References Cited

U.S. PATENT DOCUMENTS 4,586,846 A * 5/1986 Kellison ..... B28D 1/14 404/6
5,123,702 A 6/1992 Caruso
8,820,835 B2 * 9/2014 Minino ..... A47C 7/44 297/285
9,332,851 B2 * 5/2016 Machael ..... A47C 7/445
2012/0228911 A1 9/2012 Piretti

FOREIGN PATENT DOCUMENTS

EP 2497390 A1 9/2012
JP 2002355141 A 12/2002
JP 2013132402 A 7/2013

OTHER PUBLICATIONS

Italian Search Report and Written Opinion dated Mar. 18, 2016 for Application No. ITUB20154093.

* cited by examiner

*Primary Examiner* — Anthony D Barfield
(74) *Attorney, Agent, or Firm* — Patterson & Sheridan, L.L.P.

(57) ABSTRACT

A chair comprising: a support structure, a seat fixed to the support structure, and a backrest connected to the seat by means of at least one upright of plastic material, wherein said at least one upright is elastically deformable to allow a movement of the backrest between a rest position and a tilted position, wherein said at least one upright is provided with at least one vertical rib having at least one localized bending zone wherein at least one through-cut is formed, which allows bending of the vertical rib, and wherein said at least one through-cut has a first and a second stop surface that come into mutual contact in the backwards inclined position of the backrest to stop the backward bending of the upright, wherein said at least one through-cut has the shape of a closed arched slot, which extends generally along a vertical axis of said upright.

6 Claims, 5 Drawing Sheets

CHAIR WITH A TILTING BACKREST

CROSS-REFERENCE TO RELATED APPLICATIONS

This application claims benefit of Italian patent application number 102015000057736, filed Oct. 2, 2015, which is herein incorporated by reference.

BACKGROUND OF THE INVENTION

Field of the Invention

The present invention relates to a chair comprising:

a support structure;

a seat fixed to the support structure; and a backrest connected to the seat by means of at least one upright of plastic material, wherein said at least one upright is elastically deformable to allow a movement of the backrest between a rest position and a backward tilted position.

Description of Prior Art

The document EP-A-2497390 by the same Applicant describes a chair comprising a tilting backrest connected to the support structure by means of two uprights spaced apart in a transverse direction. Each of said uprights is provided with a plurality of generally transverse through-cuts relative to the longitudinal axis of the respective upright and spaced apart along this longitudinal axis. The cuts locally weaken the uprights and produce bending zones, which allow a bending of the uprights and a movement of the backrest between a rest position and a backward tilted position. The cuts divide the upright into a series of essentially non-deformable teeth that come into contact with each other in the backwards inclined position, so as to stop the backward tilt of the backrest.

When only the elasticity of a deformable material is used to obtain the bending of the uprights, it is important to provide for a limitation of the bending that prevents yielding of the material at the most stressed bending areas.

The major difficulties in the design of chairs with flexible uprights consist in the design of shapes of the flexible uprights that are harmonized with the line of the chair, capable of providing the backward bending of the backrest, to stop the bending in the position in which the required comfort is obtained, and to avoid excessive stresses of the material in the bending zones.

SUMMARY OF THE INVENTION

The present invention aims to provide a chair with flexible uprights that allows the aforementioned requirements to be satisfied.

According to the present invention, this object is achieved by a chair having the characteristics forming the subject of claim 1.

The claims form an integral part of the disclosure provided here in relation to the invention.

BRIEF DESCRIPTION OF THE DRAWINGS

The present invention will now be described in detail with reference to the attached drawings, given purely by way of non-limiting example, wherein.

DETAILED DESCRIPTION

Figure 1:
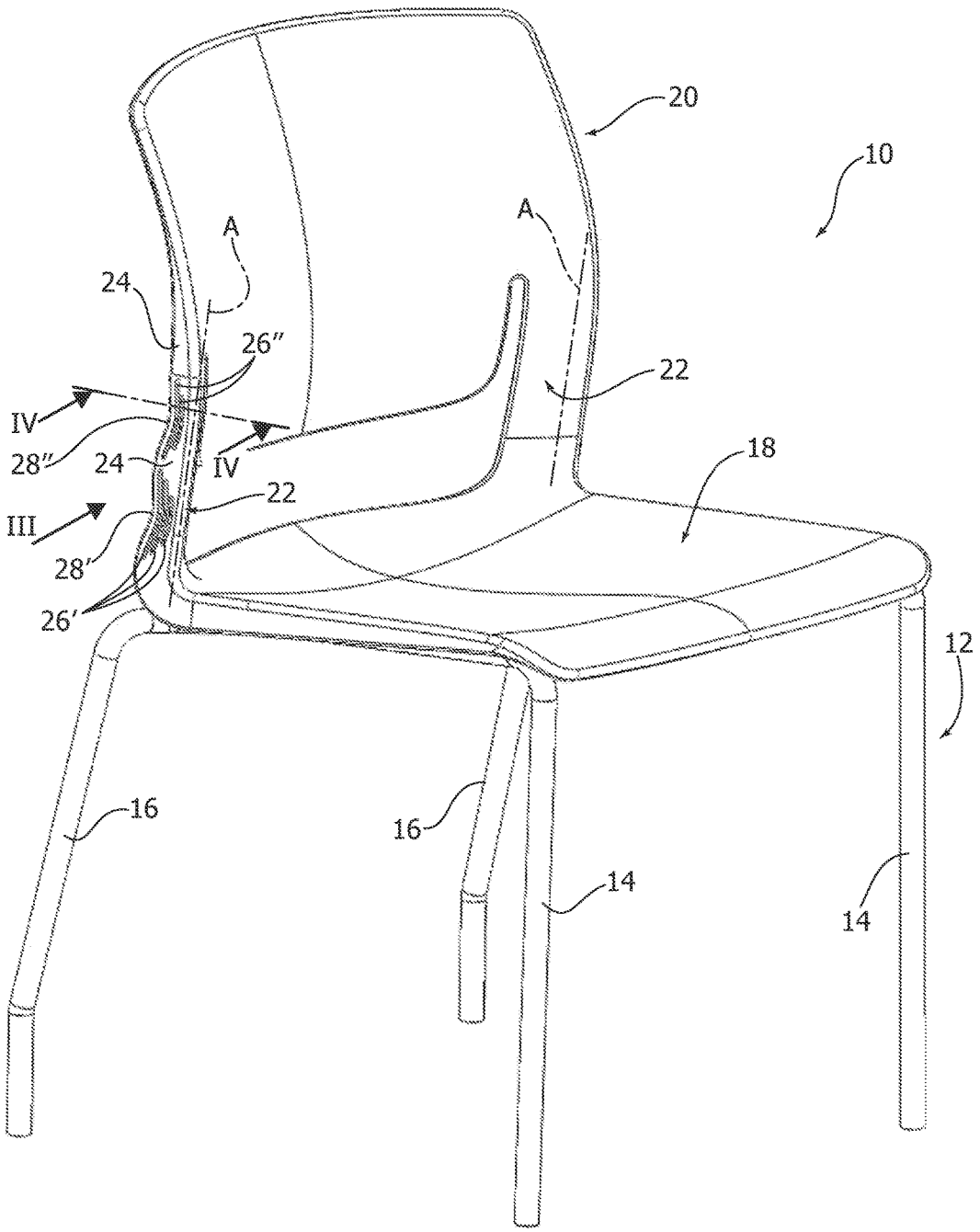
FIG. 1 is a perspective view of an embodiment of a chair according to the present invention.
Figure 2:
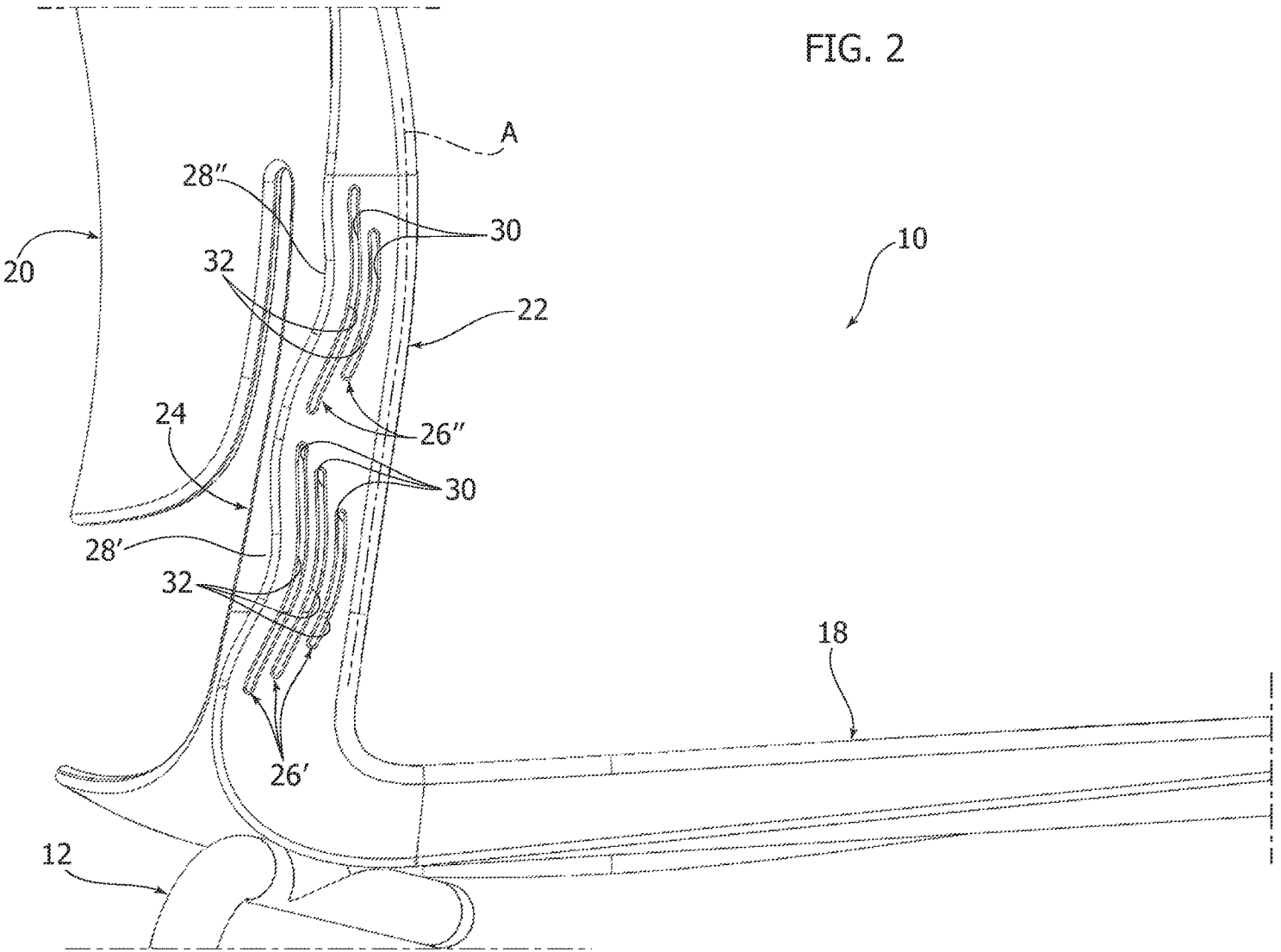
FIGS. 2 and 3 are enlarged side views of the parts indicated by the arrow III in FIG. 1, respectively, in the rest position and in the backwards inclined position.
Figure 3:
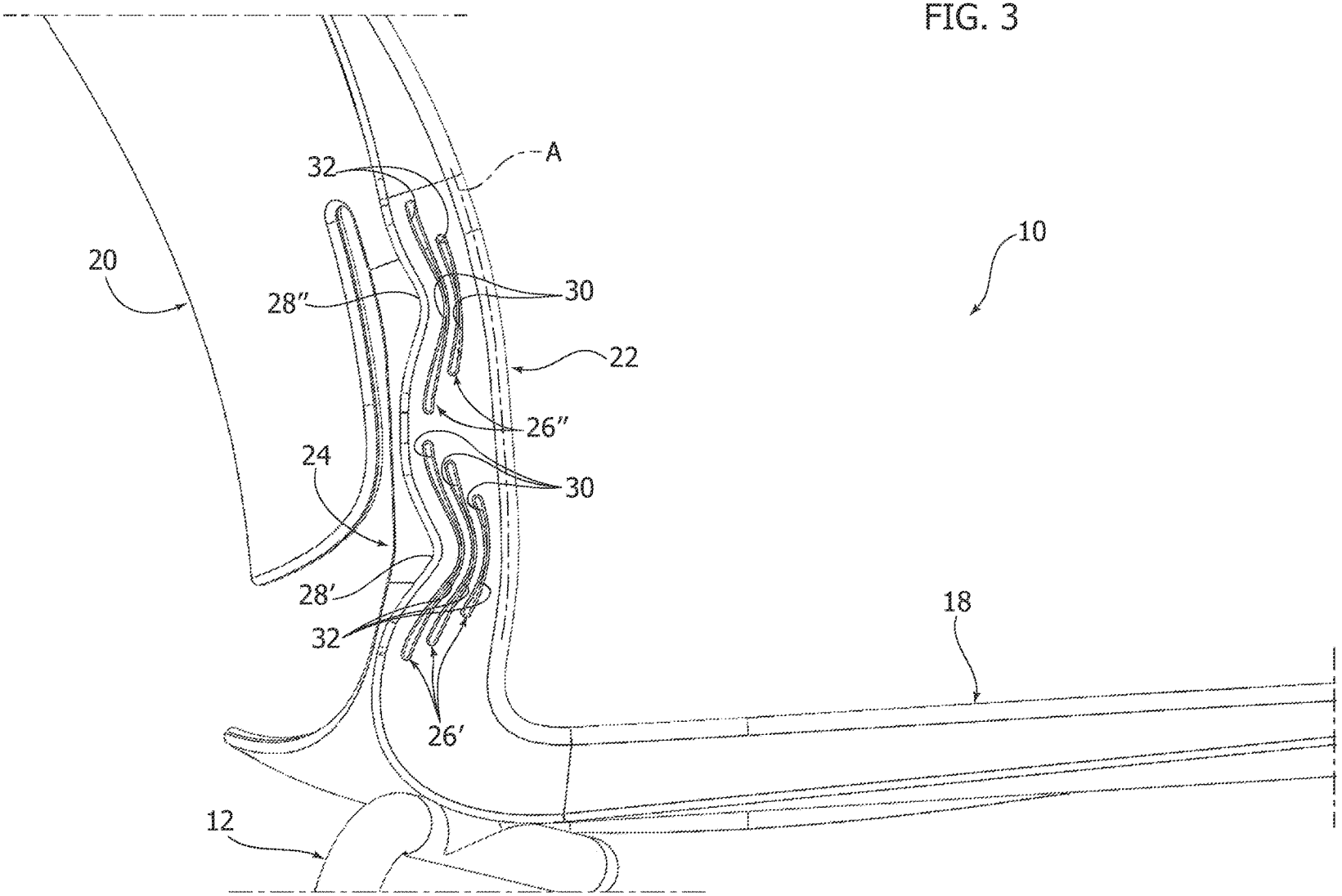
Figure 4:
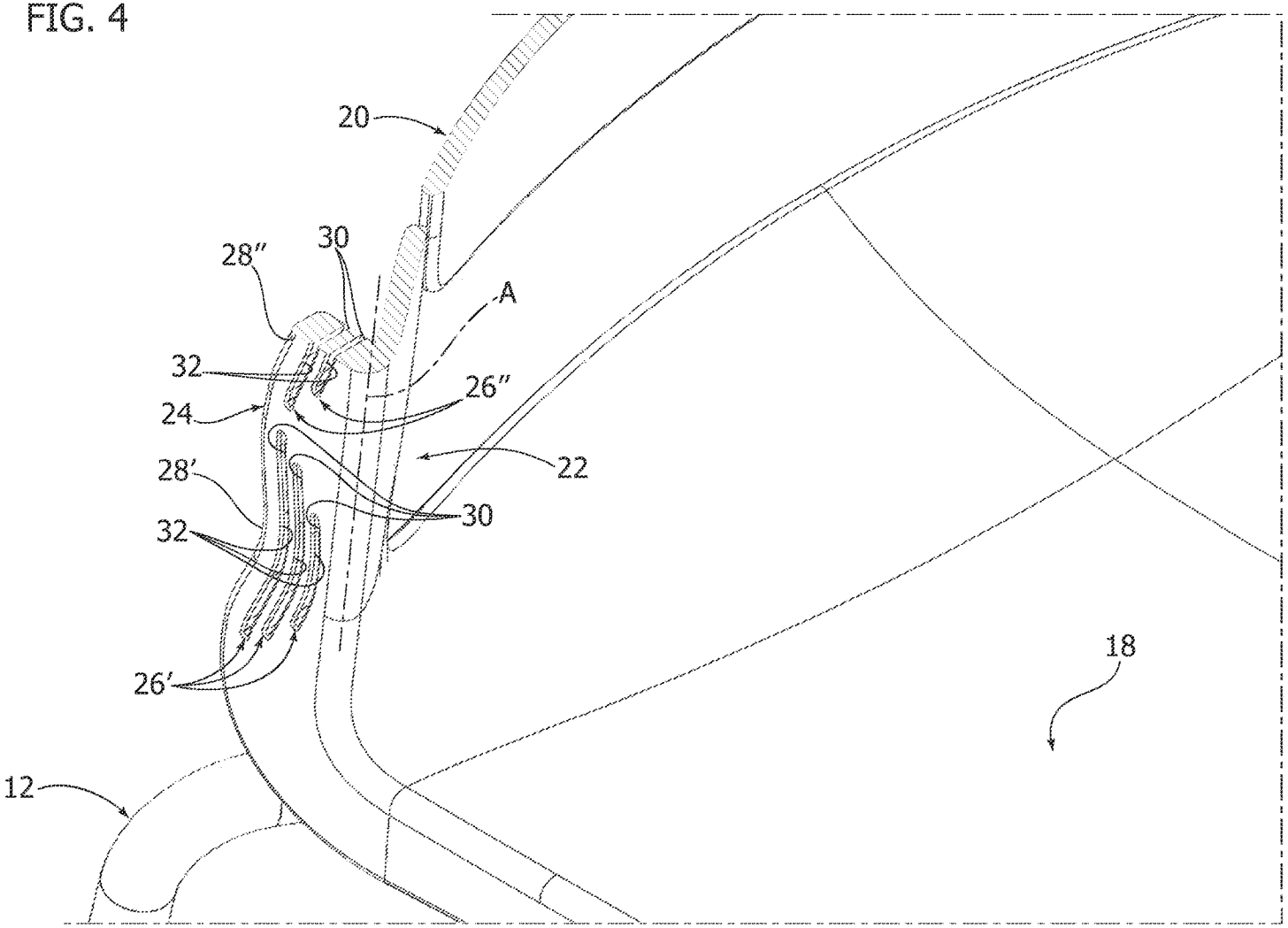
FIGS. 4 and 5 are perspective cross-sections according to the line IV-IV of FIG. 1 in the rest position and in the backwards inclined position, respectively.
Figure 5:
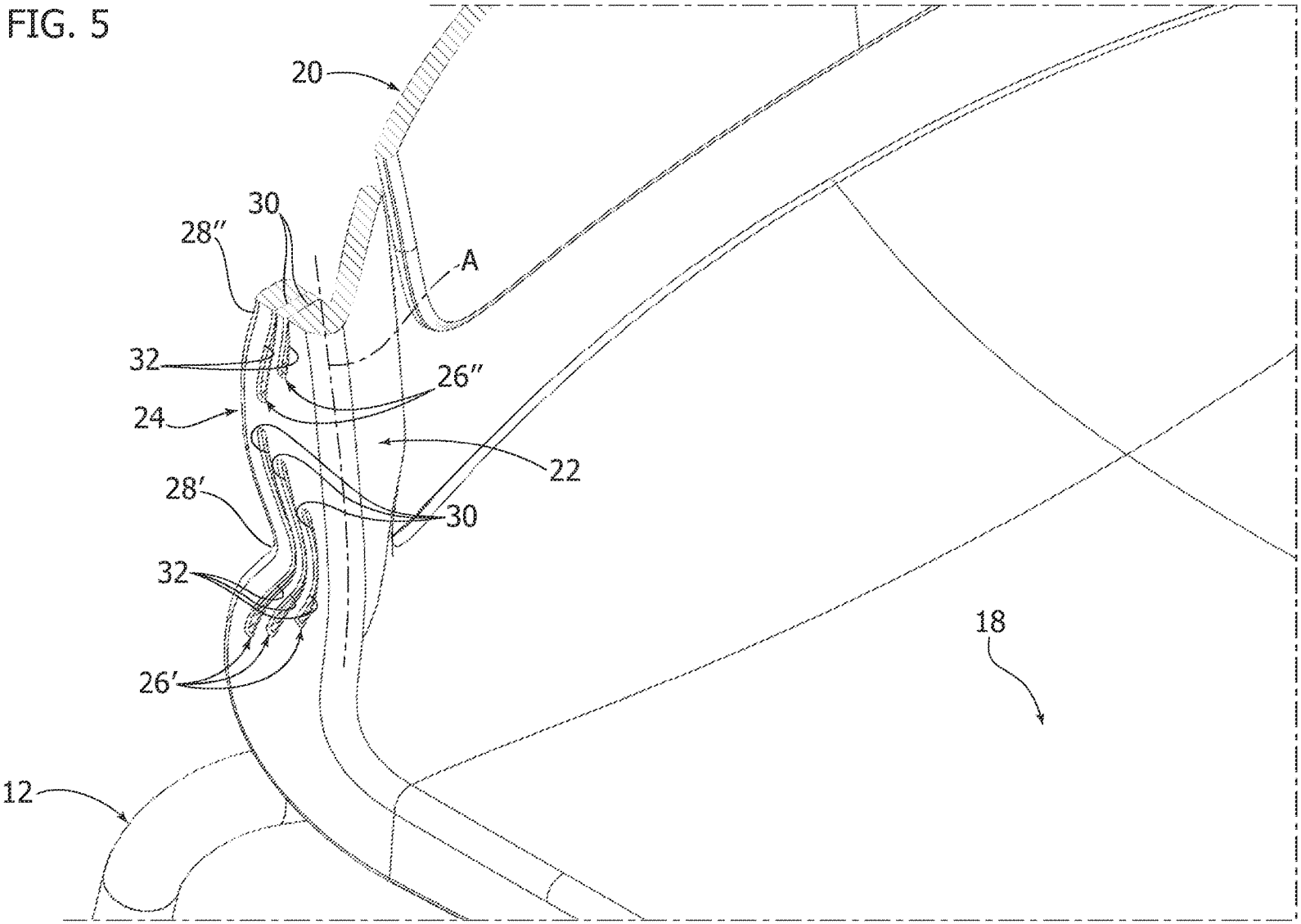

With reference to FIG. 1, numeral 10 indicates a chair according to an embodiment of the present invention. The chair 10 comprises a base structure 12 formed by a metal frame with two front legs 14 and two rear legs 16. However, this shape of the base structure 12 is not mandatory. The present invention is also applicable to different types of chairs, for example, for office chairs in which the base structure comprises a height-adjustable vertical support that rests on the ground by means of a plurality of radial arms carrying respective wheels.

The chair 10 comprises a seat 18 fixed to the base structure 12 and a backrest 20 connected to the seat 18 by means of two side uprights 22 that extend along respective vertical or essentially vertical axes A. In an alternative embodiment (not shown), the backrest 20 could be connected to the seat 18 by means of a single upright 22 arranged in a central position.

According to a preferred embodiment, the seat 18, the backrest 20 and the uprights 22 are formed of a single piece of injection-molded plastic material. Alternatively, the uprights 22 could be separate components fixed to the seat and to the backrest through a conventional type of fixing means. As a further alternative, the uprights 22 could be formed in one piece with the seat or the backrest and fixed through a conventional type of fixing means to the backrest or to the seat.

Each upright 22 is equipped with a vertical rib 24 formed integrally with the respective upright 22.

With reference to FIGS. 2-5, the rib 24 of each upright 22 is provided with one or more through-cuts 26', 26" that form at least one bending zone 28', 28" of the upright 22.

In the illustrated example, each upright has a first group of through-cuts 26' that form a first bending zone 28', and a second group of through-cuts 26" that form a second bending zone 28". The through-cuts 26', 26" extend between two opposite side walls of the rib 24.

In the drawings, a solution with two bending zones 28', 28" spaced apart in the vertical direction has been illustrated by way of example, but it is understood that the number of bending zones 28', 28" can vary from 1 to a generic number N, depending for example on the size of the uprights 22, on the length of the cuts 26', 26", and the rigidity of the uprights 22, etc. Furthermore, each bending zone could also be provided with just one through-cut 26', 26".

At each bending zone, the support profile 22 is able to carry out a bending movement under a backwards thrust applied by the user to the backrest 18. The flexibility of the uprights at the bending zones 28', 28" allows a movement of the backrest 20 between an upright rest position and a backwards inclined position. When the backwards thrust applied by the user on the backrest 20 ceases, the backrest 20 returns to the rest position due to the elastic return of the material constituting the uprights 22.

According to a characteristic of the present invention, the through-cuts 26', 26" have the shape of closed arched slots, which extend generally along the axis A of the respective upright 22. Each of the through-cuts 26', 26" has two stop surfaces 30, 32 facing each other, which extend in a manner generally parallel to the axis A of the respective upright 22. The stop surfaces 30, 32 are spaced apart by an amount such that the elastic deformation of the rib 24 into the backwards inclined position of the backrest 20 carries the stop surfaces 30, 32 into contact with each other in the bending zones 28', 28".

In each bending zone 28', 28", a plurality of through-cuts 26', 26" are preferably provided, spaced apart in a direction orthogonal to the axis A of the respective upright 22.

The slot-shaped through-cuts 26', 26" have an essentially concave profile, with the concavity facing towards the rear part of the rib 24. The cuts 26', 26" of the same group have the vertices of their respective concavity aligned along a common axis generally orthogonal to the axis A of the respective upright 22. The bending zones 28', 28" are arranged at the vertices of the concavities of the through-cuts 26', 26".

In the illustrated example, the through-cuts 26', 26" have a shallow V-shaped profile. However, the shallow V-shaped profile is not mandatory and can be replaced by any other type of profile.

As can be seen by comparing FIGS. 2, 3 and 4, 5, passing from the upright position (FIGS. 2, 4) to the backwards inclined position (FIGS. 3, 5), the profiles of the cuts 26', 26" become more accentuated, or rather, the depth of the generally V-shaped profiles increases. In the backwards inclined position (FIGS. 3, 5), the stop surfaces 30, 32 of each cut 26', 26" come into contact with each other at the respective vertices of the convex profiles. In this position, the bending rigidity of the rib 24 increases considerably. Consequently, a further backward deformation of the rib 24 is prevented.

The fact that the through-cuts 26', 26" extend generally parallel to the uprights 22 causes the uprights 22 to be less bulky. Consequently, a better stackability is obtained in the case of chairs designed to be mutually stackable.

Compared to the known solutions, for example that described in the document EP-A-2497390, in the solution according to the present invention, the bending does not occur in punctiform zones, but rather concerns larger areas. This has the advantage that, during the elastic deformations of the uprights, the material is less stressed and is less subject to risks of breakage. Furthermore, since the arched slots do not interrupt the continuity of the ribs in a complete way, compared to the solution described in the document EP-A-2497390, the solution according to the present invention is more resistant to accidental bumps that impact in the direction opposite to that of normal use.

Of course, without prejudice to the principle of the invention, the details of construction and the embodiments can be widely varied with respect to those described and illustrated, without thereby departing from the scope of the invention as defined by the claims that follow. For example, the preceding description refers to the case in which each upright 22 has a single rib 24, but the invention can also be applied in the case in which each upright 22 comprises two or more parallel vertical ribs. In this case, each rib 24 is provided with through-cuts 26', 26" arranged as described above.

The invention claimed is:

1. A chair comprising:

a support structure;

a seat fixed to the support structure; and a backrest connected to the seat through at least one upright of plastic material, wherein said at least one upright is elastically deformable to allow a movement of the backrest between a rest position and a backward tilted position, wherein said at least one upright is provided with at least one vertical rib having at least one localized bending zone in which at least one through-cut is formed, which allows bending of the vertical rib, and wherein said at least one through-cut has a first and a second stop surface that come into mutual contact in the backward tilted position of the backrest to stop the backward bending of the upright, wherein said at least one through-cut has the shape of a closed arched slot, which extends generally along a vertical axis of said upright.

2. A chair according to claim 1, wherein said at least one through-cut has a concave profile facing towards the rear part of said rib.

3. A chair according to claim 2, wherein the concave profile of said at least one through-cut has a generally shallow V-shape with a vertex located at a respective bending zone.

4. A chair according to claim 1, wherein said at least one through-cut extends between two opposite vertical surfaces of said rib.

5. A chair according to claim 1, wherein said at least one bending zone comprises a plurality of through-cuts spaced apart along a direction generally orthogonal to the vertical axis of the upright.

6. A chair according to claim 1, wherein at said at least one upright comprises a plurality of bending zones spaced apart along said vertical axis of said upright, each bending zone comprising at least one through-cut.

* * * * *